US007845180B2

(12) United States Patent
Sugaya et al.

(10) Patent No.: US 7,845,180 B2
(45) Date of Patent: Dec. 7, 2010

(54) AUTOMATIC ICEMAKER

(75) Inventors: Kenji Sugaya, Kiryu (JP); Yoshihisa Kagawa, Kiryu (JP); Hideaki Ito, Kiryu (JP)

(73) Assignee: Japan Servo Co., Ltd., Tokyo (JP)

( * ) Notice: Subject to any disclaimer, the term of this patent is extended or adjusted under 35 U.S.C. 154(b) by 613 days.

(21) Appl. No.: 11/716,550

(22) Filed: Mar. 12, 2007

(65) Prior Publication Data

US 2007/0209381 A1 Sep. 13, 2007

(30) Foreign Application Priority Data

Mar. 13, 2006 (JP) ..... 2006-067084

(51) Int. Cl.
*F25C 1/00* (2006.01)

(52) U.S. Cl. ..... 62/137; 62/353

(58) Field of Classification Search ..... 62/137, 62/351, 345

See application file for complete search history.

(56) References Cited

U.S. PATENT DOCUMENTS

| | | | | |
|---|---|---|---|---|
| 3,055,185 | A * | 9/1962 | Lundstrom | 62/138 |
| 3,306,064 | A * | 2/1967 | Poolos | 62/137 |
| 4,635,444 | A * | 1/1987 | Mawby et al. | 62/125 |
| 5,345,783 | A * | 9/1994 | Nishikawa | 62/345 |
| 5,829,266 | A * | 11/1998 | Lyu | 62/353 |
| 5,970,725 | A * | 10/1999 | Lee | 62/137 |
| 6,145,320 | A * | 11/2000 | Kim | 62/6 |
| 6,481,235 | B2 * | 11/2002 | Kwon | 62/353 |
| 2004/0177638 | A1 * | 9/2004 | Onishi et al. | 62/351 |

FOREIGN PATENT DOCUMENTS

| | | | |
|---|---|---|---|
| JP | 5-248746 | A | 9/1993 |
| JP | 06313659 | A | 11/1994 |
| JP | 06323704 | A * | 11/1994 |
| JP | 2000-346506 | A | 12/2000 |
| JP | 2001-56168 | A | 2/2001 |
| JP | 2003-269832 | A | 9/2003 |
| JP | 2003-343949 | A | 12/2003 |

* cited by examiner

*Primary Examiner*—Frantz F Jules
*Assistant Examiner*—Emmanuel Duke
(74) *Attorney, Agent, or Firm*—Birch, Stewart, Kolasch & Birch, LLP

(57) ABSTRACT

An automatic icemaker of the present invention includes a control box, an ice-making tray supporting frame rotatably supported and rotated by the control box, at least one ice-making tray rotatably supported by the ice-making tray supporting frame, a rotation limiter fixed to the ice-making tray supporting frame and limiting the rotation of the ice-making tray, a stopper fixed to the control box, and a projection provided to the ice-making tray. Irregularities are provided to at least one of the contact surfaces of the stopper and projection.

18 Claims, 7 Drawing Sheets

AUTOMATIC ICEMAKER

BACKGROUND OF THE INVENTION

1. Field of the Invention

The present invention relates to an automatic icemaker for supplying water, making ice, and discharging ice repeatedly in accordance with predetermined sequence.

2. Description of the Related Art

The general usage of conventional automatic icemakers mounted to household refrigerators is as follows. The automatic icemaker is installed in a freezer. Water is supplied to ice molds from above an ice-making tray of the automatic icemaker. The water in the ice molds is cooled at ambient temperature. After ice is made, the ice-making tray is twisted to eject the ice. In this case, the ice is not ejected from the ice-making tray certainly due to the adhesion force between the ice-making tray and ice even when the ice-making tray is twisted. To eject the ice certainly, solutions for improving a shape and material of the ice-making tray and a method for the ice ejection have been suggested.

For example, the solutions are as follows. The shape of the ice molds is made to have a lozenge or parallelogram shape. A mixture including a material having a large contact angle with water is used as a material for the ice-making tray, the mixture being such as silicon. Ice molds are provided to both sides of the ice-making tray, and when ice is ejected from the ice molds of one side, water is supplied to the ice molds of another side. Two stoppers for twisting the ice-making tray are disposed such that the ice-making tray is twisted by one stopper, and after that, the tray is rotated oppositely, and twisted by another stopper to eject the ice.

However, the above solutions need to use an ice-making tray having a special shape and material and a complicated control method and mechanism.

SUMMARY OF THE INVENTION

An object of the present invention is to provide an automatic icemaker using a simple control method and mechanism to eject ice certainly without using an ice-making tray having a special shape and material.

In the present invention, the automatic icemaker includes: a control box; an ice-making tray supporting frame rotatably supported and rotated by the control box; at least one ice-making tray rotatably supported by the ice-making tray supporting frame; a rotation limiter fixed to the ice-making tray supporting frame and limiting the rotation of the ice-making tray; a stopper fixed to the control box; and a projection provided to the ice-making tray. Irregularities are provided to at least one of the contact surfaces of the stopper and projection.

In this automatic icemaker, since the ice-making tray is twisted and vibrated, the ice can be ejected certainly. Additionally, the automatic icemaker uses a simple control method and mechanism without using an ice-making tray having a special shape and material.

DETAILED DESCRIPTION OF THE INVENTION

Figure 1:
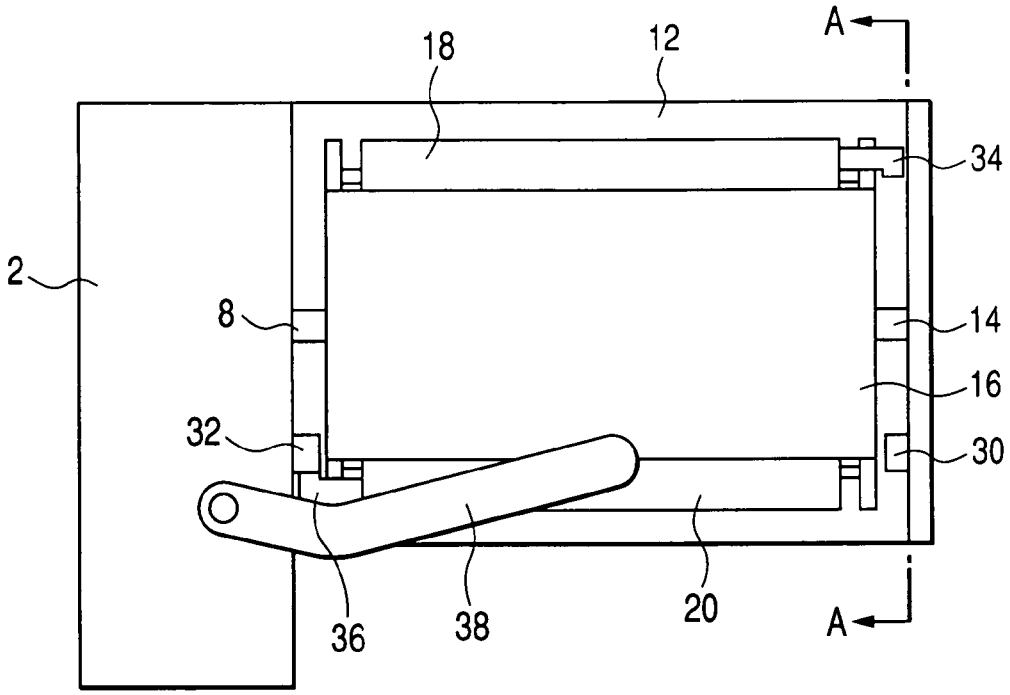
FIG. 1 is a front view of an automatic icemaker of the present invention.
Figure 2:
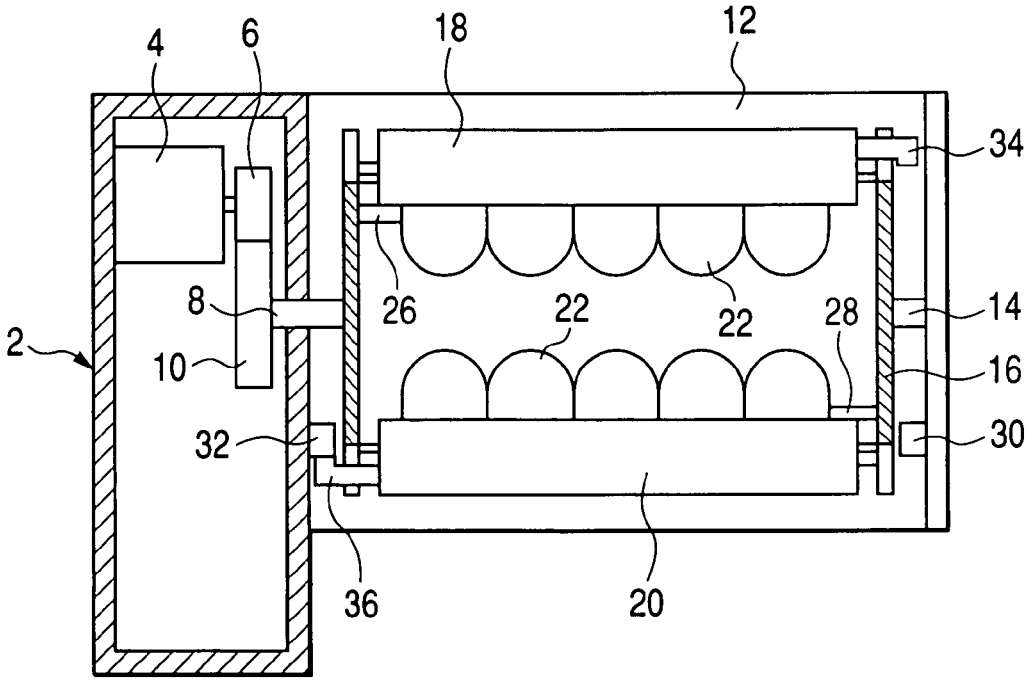
FIG. 2 is a front cross section view of the automatic icemaker of FIG. 1.
Figure 3:
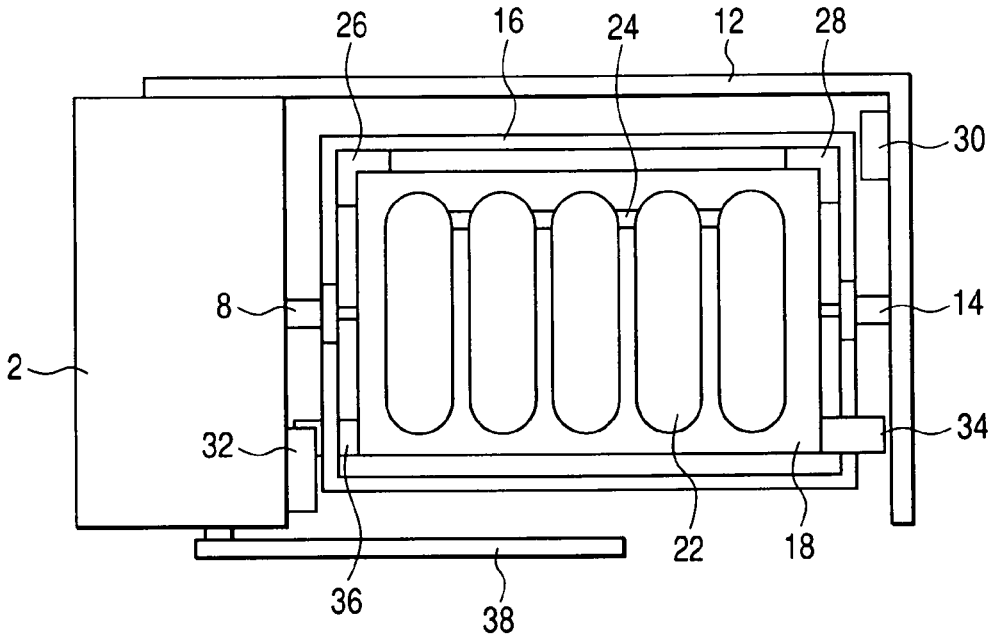
FIG. 3 is a plan view of the automatic icemaker of FIG. 1.
Figure 4:
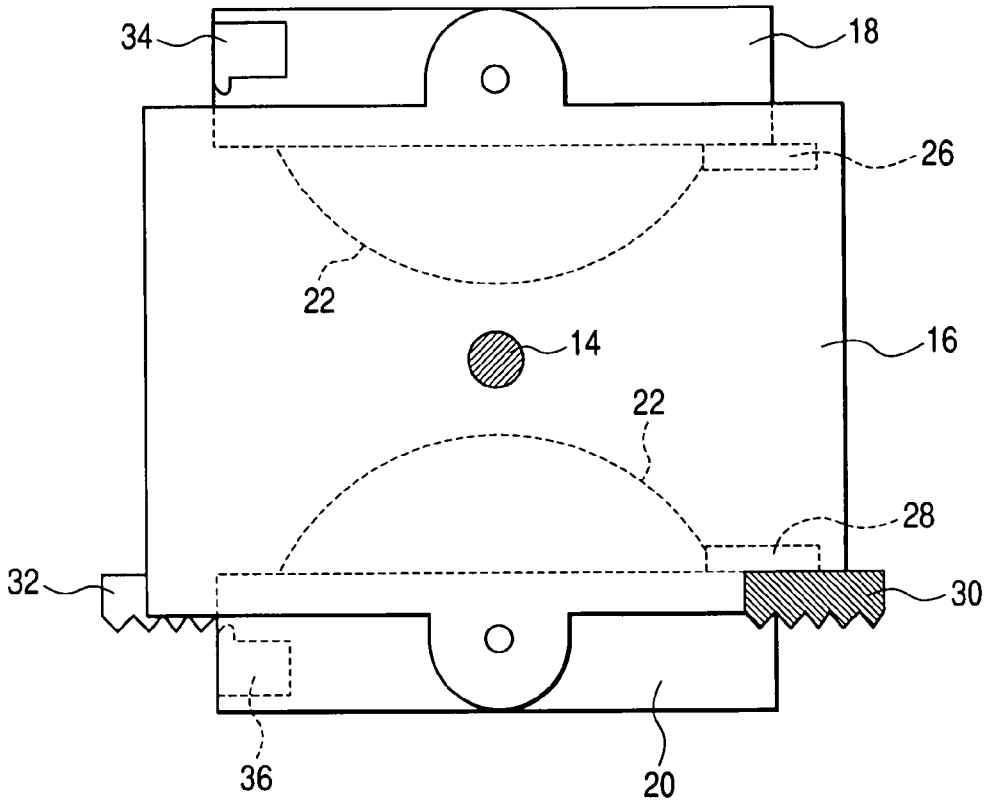
FIG. 4 is an enlarged cross section view of the line A-A of FIG. 1.
Figure 5:
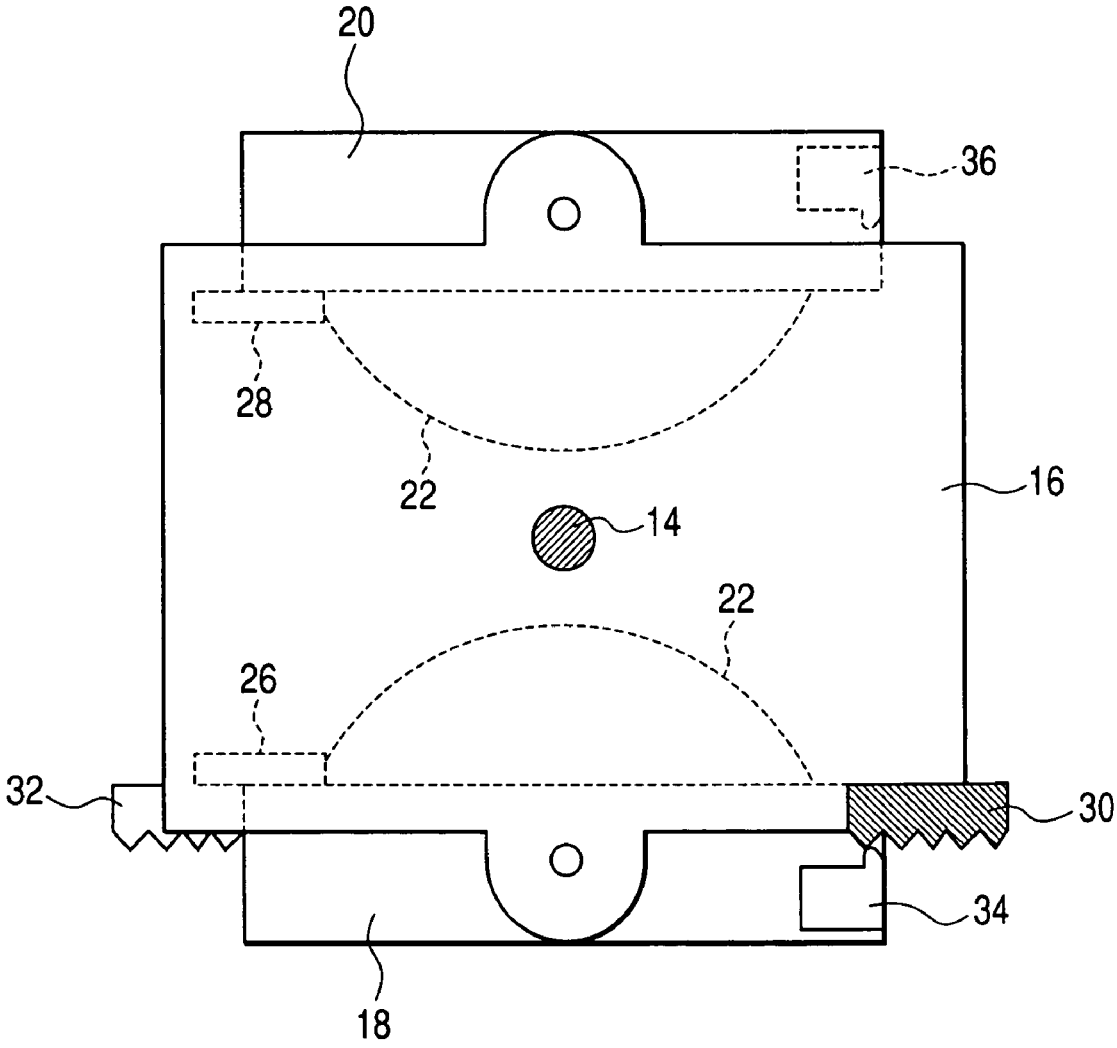
FIGS. 5, 6 show operation of the automatic icemaker of FIGS. 1 to 4.

In reference to FIGS. 1 to 4, an automatic icemaker of the present invention is explained. A motor 4 is fixed to a body of a control box 2. A gear 6 is mounted to an output shaft of the motor 4. A rotation shaft 8 is rotatably supported by the body of the control box 2. A gear 10 is mounted to the rotation shaft 8. The gears 6, 10 are engaged with each other. A frame supporting member 12 is fixed to the body of the control box 2. A rotation shaft 14 is rotatably supported by the frame supporting member 12. A rotation centerline of the rotation shaft 8 is coincident with that of the rotation shaft 14. An ice-making tray supporting frame 16 is mounted to end portions of the rotation shafts 8, 14. The ice-making tray supporting frame 16 is rotatably supported and rotated by the control box 2. Ice-making trays 18, 20, which can be twisted, are rotatably supported by the ice-making tray supporting frame 16. Rotation centerlines of the ice-making trays 18, 20 are parallel to a rotation centerline of the ice-making tray supporting frame 16, namely to the rotation centerlines of the rotation shafts 8, 14. The rotation centerlines of the ice-making trays 18, 20 are separated from the rotation centerline of the ice-making tray supporting frame 16 by a predetermined distance. Multiple ice molds 22 are provided to the ice-making trays 18, 20. Communicating portions 24 are provided for communicating between the ice molds 22 next to the ice-making trays 18, 20. A rotation limiter 26 is fixed to an upper portion of the ice-making tray supporting frame 16 in FIG. 3 toward the control box 2. In the state of FIG. 4, the rotation limiter 26 limits the clockwise rotation of the ice-making tray 18. A rotation limiter 28 is fixed to an upper portion of the ice-making tray supporting frame 16 in FIG. 3 oppositely to the control box 2. In the state of FIG. 4, the limiter 28 limits the counterclockwise rotation of the ice-making tray 20. A stopper 30 is fixed to the frame supporting member 12 and above the rotation shaft 14 in FIG. 3. In other words, the stopper 30 is fixed to the control box 2. A stopper 32 is fixed to the body of the control box 2 and below the rotation shaft 8 in FIG. 3. Bottom surfaces, namely contact surfaces, of the stoppers 30, 32 are provided with irregularities having isosceles triangle shapes. A projection 34 is integrally formed to a lower portion of the ice-making tray 18 in FIG. 3. A protrusion is provided to a bottom face in FIG. 4, namely a contact face, of the projection 34. A projection 36 is integrally formed to a lower portion of the ice-making tray 20 in FIG. 3. A protrusion is provided to an upper surface in FIG. 4, namely a contact surface, of the projection 36. As shown in FIG. 5, the stopper 30 and projection 34 are disposed such that their contact surfaces come in contact with each other when the ice-making tray supporting frame 16 is inverted. As shown in FIG. 4, the stopper 32 and projection 36 are disposed such that their contact surfaces come in contact with each other. A detection lever 38 for detecting whether the ice molds are filled with ice is mounted to the body of the control box 2.

Figure 6:
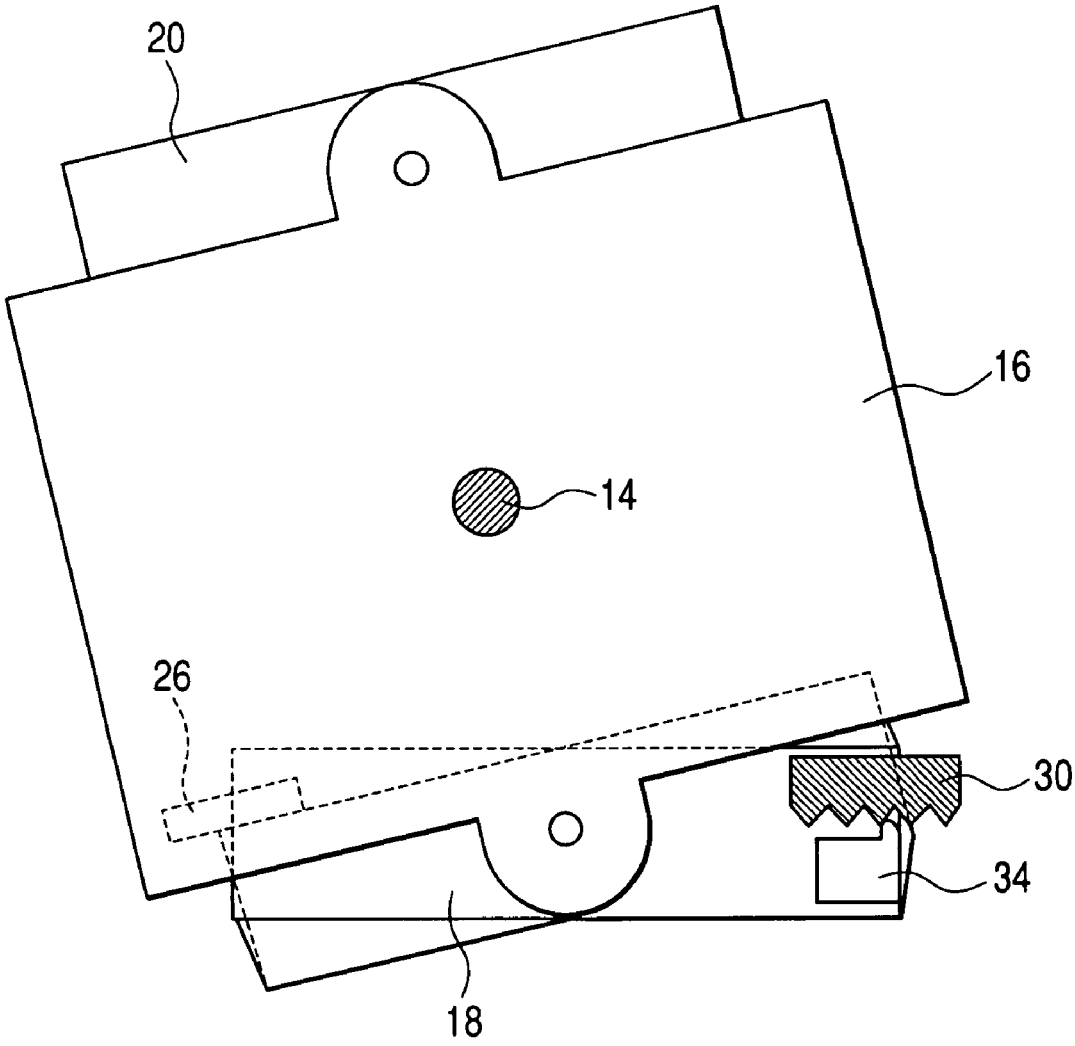

This automatic icemaker is installed in a freezer of a household refrigerator. In the states of FIGS. 1 to 4, water is supplied into the ice molds 22 of the ice-making tray 18, and then cooled at ambient temperature, so that ice is made in the ice molds 22. After a predetermined time, the motor 4 rotates the ice-making tray supporting frame 16 in the counterclockwise direction of FIG. 4 to invert the ice-making tray supporting frame 16 to the position shown in FIG. 5. At this time, the contact surface of the projection 34 comes into contact with the contact surface of the stopper 30. After that, the motor 4 further rotates the ice-making tray supporting frame 16 in the counterclockwise direction of FIG. 5 to the position shown in FIG. 6. Then, the projection 34 is limited by the stopper 30, and the rotation of an end portion of the ice-making tray 18, the end portion facing to the control box 2, is limited by the rotation limiter 26. Accordingly, the ice-making tray 18 is twisted. In this case, when the ice-making tray supporting frame 16 rotates from the state of FIG. 5 to the position shown in FIG. 6, the rotation shaft of the ice-making tray 18 moves in the right direction of FIG. 6 relative to the rotation shaft 14. Accordingly, the projection 34 moves in the right direction of FIG. 6 relative to the stopper 30. Additionally, since the irregularities are provided to the contact surface of the stopper 30, the projection 34 moves vibrating up and down. As a result, since the ice-making tray 18 is twisted and vibrated, the ice in the ice molds 22 falls downward.

Next, the motor 4 rotates the ice-making tray supporting frame 16 to the position shown in FIG. 5, and water is supplied into the ice molds 22 of the ice-making tray 20. The water in the ice molds 22 is cooled at ambient temperature, and ice is made in the ice molds 22. After a predetermined time, the motor 4 rotates the ice-making tray supporting frame 16 in the clockwise direction of FIG. 5 to the position shown in FIG. 4. At this time, the contact surface of the projection 36 comes into contact with the contact surface of the stopper 32. After that, when the motor 4 further rotates the ice-making tray supporting frame 16 in the clockwise direction of FIG. 4, the stopper 32 limits the rotation of the projection 36, and the rotation limiter 28 limits the rotation of an end portion of the ice-making tray 20, the end portion being opposite to the control box 2. Accordingly, the ice-making tray 20 is twisted, and the projection 36 moves in the left direction of FIG. 4 relative to the stopper 32 with vibrating up and down. As a result, since the ice-making tray 20 is twisted and vibrated, the ice in the ice molds 22 falls downward.

Next, when the motor 4 rotates the ice-making tray supporting frame 16 to the position shown in FIG. 4, and water is supplied into the ice molds 22 of the ice-making tray 18, the water in the ice molds 22 is cooled at ambient temperature, and ice is made in the ice molds 22. Such operation is repeated to make ice automatically.

In such an automatic icemaker, since the ice-making trays 18, 20 are twisted and vibrated on ejecting ice, the ice can be ejected certainly. Additionally, the ice-making trays 18, 20 do not need to use a special shape and material, and the control method and mechanism are simple. Since the ice-making trays 18, 20 are vibrated to eject the ice, an amount of the twist of the ice-making trays 18, 20 can be made small, increasing the lifetime of the ice-making trays 18, 20. Additionally, the load on the motor 4 can be reduced, the power consumption can be reduced, and the driving components can be made compact.

Figure 7:
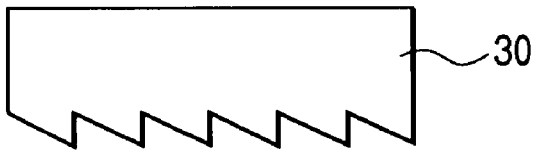
FIG. 7 shows a stopper of another automatic icemaker of the present invention.

As shown in FIG. 7, when irregularities having right triangle shapes are provided to the contact surface of the stopper 30 (32), the vibration applied to the ice-making tray 18 (20) can be increased.

Figure 8:
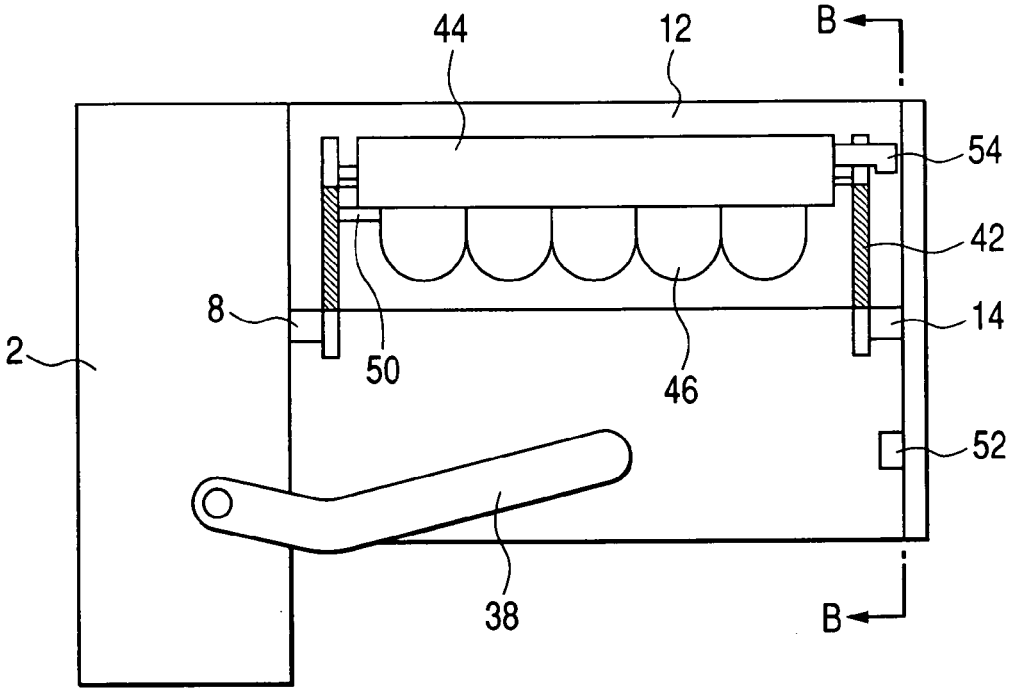
FIG. 8 is a front cross section view of another automatic icemaker of the present invention.
Figure 9:
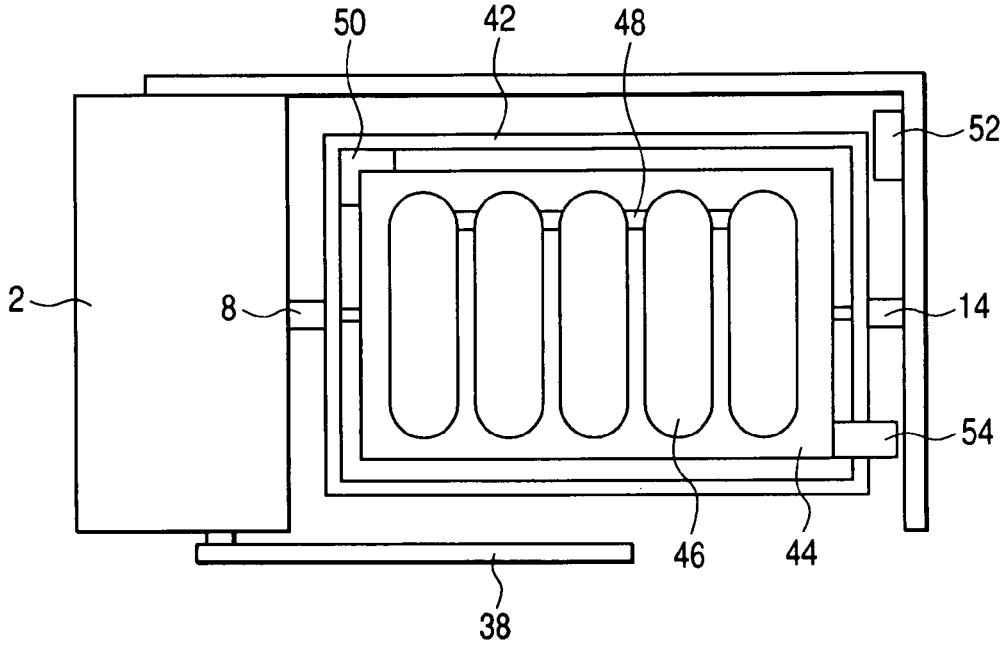
FIG. 9 is a plan view of the automatic icemaker of FIG. 8.
Figure 10:
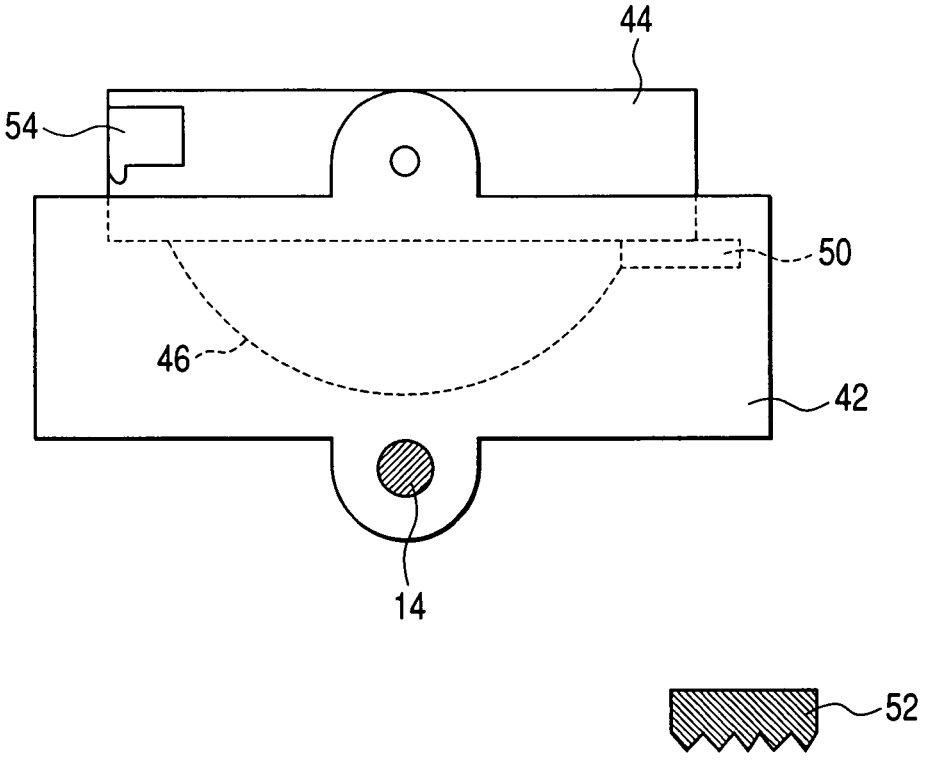
FIG. 10 is an enlarged cross section view of the line B-B of FIG. 8.
Figure 11:
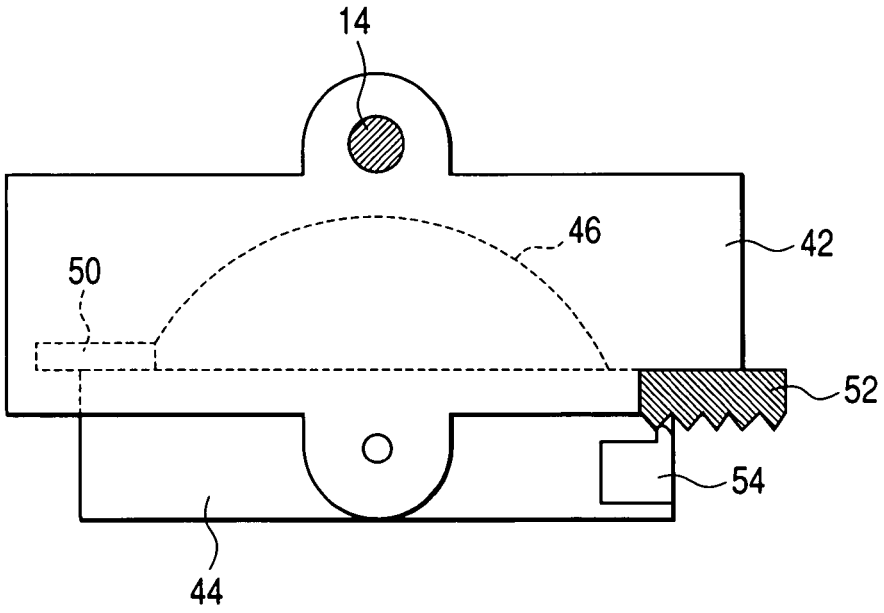
FIG. 11 shows operation of the automatic icemaker of FIGS. 8 to 10.

In reference to FIGS. 8 to 10, another automatic icemaker of the present invention is explained. An ice-making tray supporting frame 42 is mounted to the end portions of the rotation shafts 8, 14. In other words, the ice-making tray supporting frame 42 is rotatably supported and rotated by the control box 2. An ice-making tray 44 is rotatably supported by the ice-making tray supporting frame 42. The rotation centerline of the ice-making tray 44 is parallel to the rotation centerline of the ice-making tray supporting frame 42, namely to the rotation centerlines of the rotation shafts 8, 14. The rotation centerline of the ice-making tray 44 is separated from the rotation centerline of the ice-making tray supporting frame 42 by a predetermined distance. Multiple ice molds 46 are provided to the ice-making tray 44. Communicating portions 48 are provided for communicating between the ice molds 46 next to the ice-making tray 44. A rotation limiter 50 is fixed to an upper portion of the ice-making tray supporting frame 42 in FIG. 9 toward the control box 2. In the state of FIG. 10, the rotation limiter 50 limits the clockwise rotation of the ice-making tray 44. A stopper 52 is fixed to the frame supporting member 12 and above the rotation shaft 14 in FIG. 9. In other words, the stopper 52 is fixed to the control box 2. Irregularities are provided to the bottom surface, namely the contact surface, of the stopper 52. A projection 54 is integrally formed to the lower portion of the ice-making tray 44 in FIG. 9. A protrusion is provided to the bottom surface in FIG. 9, namely the contact surface, of the projection 54. As shown in FIG. 11, the stopper 52 and projection 54 are disposed such that their contact surfaces come into contact with each other when the ice-making tray supporting frame 42 is inverted.

This automatic icemaker is installed in a freezer of a household refrigerator. In the states of FIGS. 8 to 10, when water is supplied to the ice molds 46 of the ice-making tray 44, the water in the ice molds 46 is cooled at ambient temperature, and ice is made in the ice molds 46. After a predetermined time, the motor 4 rotates the ice-making tray supporting frame 42 in the counterclockwise direction of FIG. 10 to invert the ice-making tray supporting frame 42 to the position shown in FIG. 11. At this time, the contact surface of the projection 54 comes into contact with the contact surface of the stopper 52. After that, when the motor 4 further rotates the ice-making tray supporting frame 42 in the counterclockwise direction of FIG. 11, the projection 54 is limited by the stopper 52 and the rotation of the end portion of the ice-making tray 44, the end portion facing to the control box 2, is limited by the rotation limiter 50. Accordingly, the ice-making tray 44 is twisted, and the projection 54 moves in the right direction of FIG. 11 relative to the stopper 52 with vibrating up and down. Then, the ice-making tray 44 is twisted and vibrated, so that the ice in the ice molds 46 falls downward.

Next, the motor 4 rotates the ice-making tray supporting frame 42 to the position shown in FIG. 10 to supply water into the ice molds 46 of the ice-making tray 44. Then, the water in the ice molds 46 is cooled, and ice is made in the ice molds 46. Such operation is repeated to make ice automatically.

Figure 12:
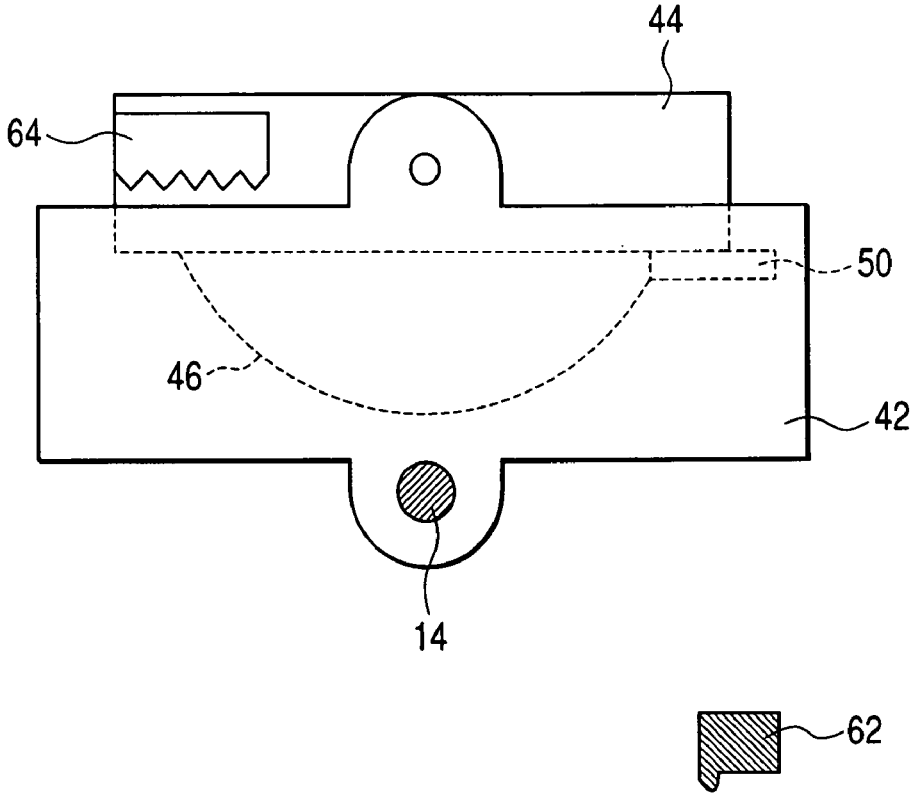
FIG. 12 is a cross section view showing part of another automatic icemaker of the present invention.
Figure 13:
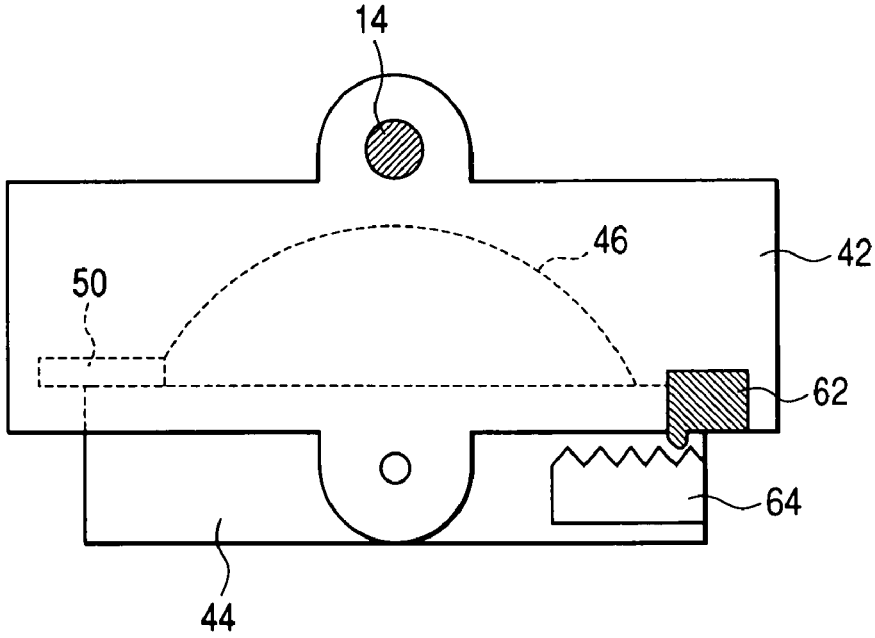
FIG. 13 shows operation of the automatic icemaker of FIG. 12.

In reference to FIG. 12, another automatic icemaker of the present invention is explained. A stopper 62 is fixed to the frame supporting member 12. In other words, the stopper 62 is fixed to the control box 2. A protrusion is provided to the bottom surface, namely the contact surface, of the stopper 62. A projection 64 is integrally formed to the ice-making tray 44. Irregularities are provided to the bottom surface in FIG. 12, namely the contact surface, of the projection 64. As shown in FIG. 13, the stopper 62 and projection 64 are disposed such that their contact surfaces come into contact with each other when the ice-making tray supporting frame 42 is inverted.

This automatic icemaker is installed in a freezer of a household refrigerator. In the state of FIG. 12, when water is supplied into the ice molds 46 of the ice-making tray 44, the water is cooled at ambient temperature, and ice is made in the ice molds 46. After a predetermined time, the motor 4 rotates the ice-making tray supporting frame 42 in the counterclockwise direction of FIG. 12 to invert the ice-making tray supporting frame 42 to the position shown in FIG. 13. At this time, the contact surface of the projection 64 comes into contact with the contact surface of the stopper 62. The contact surface of the projection 64 has the irregularities. After that, the motor 4 further rotates the ice-making tray supporting frame 42 in the counterclockwise direction of FIG. 13. Then, the projection 64 is limited by the stopper 62. The rotation of the end portion of the ice-making tray 44, the end portion facing to the control box 2, is limited by the rotation limiter 50. Then, the ice-making tray 44 is twisted, and the projection 64 moves in the right direction of FIG. 13 relative to the stopper 62 with vibrating up and down. Accordingly, the ice-making tray 44 is twisted and vibrated, so that the ice in the ice molds 46 falls downward.

What is claimed is:

1. An automatic icemaker comprising:

a control box;

an ice-making tray supporting frame rotatably supported and rotated by said control box;

at least one ice-making tray rotatably supported by said ice-making tray supporting frame;

a rotation limiter fixed to said ice-making tray supporting frame, and limiting rotation of said ice-making tray with respect to the ice-making tray supporting frame;

a stopper fixed to said control box, a contact surface of said stopper being provided with irregularities; and a projection integrally mounted to said ice-making tray.

2. The automatic icemaker of claim 1, wherein said at least one ice-making tray comprises two ice-making trays supported by said ice-making tray supporting frame.

3. The automatic icemaker of claim 1, wherein a contact surface of said projection is provided with a protrusion.

4. The automatic icemaker of claim 1, wherein said projection directly engages with said contact surface of said stopper.

5. The automatic icemaker of claim 1, said at least one ice-making tray is twisted for discharging ice cubes when said projection directly engages with said contact surface of said stopper.

6. The automatic icemaker of claim 1, wherein said automatic icemaker comprises two ice-making trays arranged back to back.

7. The automatic icemaker of claim 6, wherein said two ice-making trays are twisted for discharging ice cubes in turn.

8. The automatic icemaker of claim 1, wherein said projection directly engages with said contact surface of said stopper so that said at least one ice-making tray is vibrated and twisted for discharging ice cubes.

9. The automatic icemaker of claim 1, wherein an engagement of the rotation limiter and said at least one ice-making tray and an engagement of the projection and the contact surface of said stopper are respectively arranged in two opposite sides of the said at least one ice-making tray so that said at least one ice-making tray is vibrated and twisted for discharging ice cubes.

10. An automatic icemaker comprising:

a control box;

an ice-making tray supporting frame rotatably supported and rotated by said control box;

at least one ice-making tray rotatably supported by said ice-making tray supporting frame;

a rotation limiter fixed to said ice-making tray supporting frame, and limiting rotation of said ice-making tray with respect to the ice-making tray supporting frame;

a stopper fixed to said control box; and a projection integrally mounted to said ice-making tray, a contact surface of said projection being provided with irregularities.

11. The automatic icemaker of claim 10, wherein said at least one ice-making tray comprises two ice-making trays supported by said ice-making tray supporting frame.

12. The automatic icemaker of claim 10, wherein a contact surface of said stopper is provided with a protrusion.

13. The automatic icemaker of claim 10, wherein said stopper directly engages with said contact surface of said projection.

14. The automatic icemaker of claim 10, said at least one ice-making tray is twisted for discharging ice cubes when said stopper directly engages with said contact surface of said projection.

15. The automatic icemaker of claim 10, wherein said automatic icemaker comprises two ice-making trays arranged back to back.

16. The automatic icemaker of claim 15, wherein said two ice-making trays are twisted for discharging ice cubes in turn.

17. The automatic icemaker of claim 10, wherein said projection directly engages with said contact surface of said stopper so that said at least one ice-making tray is vibrated and twisted for discharging ice cubes.

18. The automatic icemaker of claim 10, wherein an engagement of the rotation limiter and said at least one ice-making tray and an engagement of the projection and the contact surface of said stopper are respectively arranged in two opposite sides of the said at least one ice-making tray so that said at least one ice-making tray is vibrated and twisted for discharging ice cubes.

* * * * *